US005307047A

United States Patent [19]

Morioka

[11] Patent Number: 5,307,047

[45] Date of Patent: Apr. 26, 1994

[54] EMERGENCY RING

[76] Inventor: Haruyo Morioka, 1-62-14 Umegaoka, Setagaya-ku, Tokyo, Japan

[21] Appl. No.: 850,837

[22] Filed: Mar. 13, 1992

[51] Int. Cl.[5] ..... G08B 3/00

[52] U.S. Cl. ..... 340/384.4; 340/321; 340/692; 340/546; 340/522

[58] Field of Search ..... 340/384 E, 321, 546, 340/522, 692, 693

[56] References Cited

U.S. PATENT DOCUMENTS

| | | | |
|---|---|---|---|
| 3,825,833 | 7/1970 | Bogne et al. | 340/574 |
| 3,986,184 | 10/1976 | Castanino et al. | 340/304 |
| 4,038,976 | 8/1977 | Hardy et al. | 128/690 |
| 4,061,910 | 12/1977 | Rosenfeld | 362/104 |
| 4,973,944 | 11/1990 | Maletta | 340/693 |

OTHER PUBLICATIONS

Radio Shack 1990 Calalog p., 155. The multi-function digital watches.

*Primary Examiner*—John K. Peng
*Assistant Examiner*—Nina Tong
*Attorney, Agent, or Firm*—G. Donald Weber, Jr.

[57] ABSTRACT

This is a ring fitted with a device that sounds an alarm during times of emergencies. The special features of the ring are a transmission circuit and alarm device that emits a sound enclosed in the setting of the ring. The switches are at the top of the setting forming a connection between the transmission circuit and the battery when pressed.

2 Claims, 1 Drawing Sheet

FIG. 1
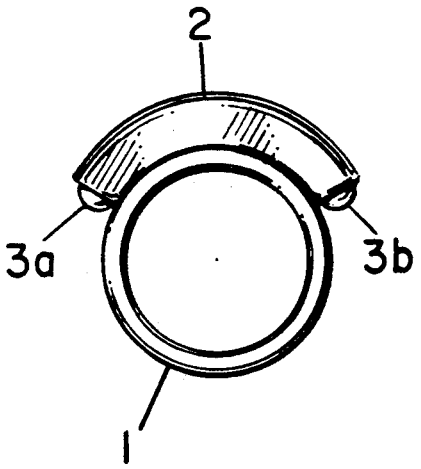
FIG. 2
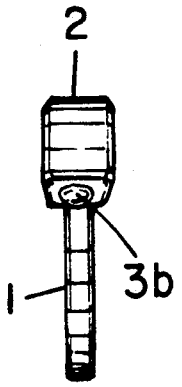
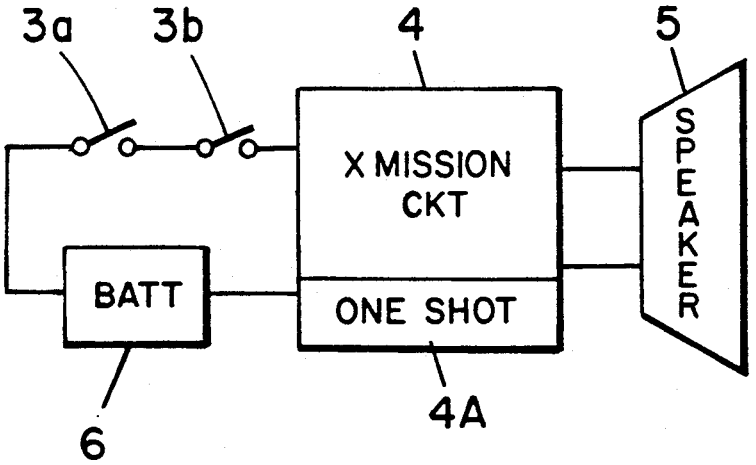
FIG. 3

EMERGENCY RING

BACKGROUND

1. Field of the Invention

This invention relates to a ring with an alarm device, in general, and to a ring selectively operative for emitting a sound to call people in times of emergencies, in particular.

2. Prior Art

For the elderly and the physically handicapped, particularly those who suffer from heart disease or high blood pressure, symptoms can suddenly appear at any time or place. Whether in the bath or in the toilet, when someone is struck by severe pain and is unable to call out, even people living in the same household may be unaware of the trouble. There have been many instances of time thus uselessly wasted until it was too late to help.

Carrying pocket pagers, portable phones, or other devices utilizing radio waves is inconvenient and in an emergency the person might not be able to operate the device. In addition, this type of device is inappropriate for household use. Systems for notifying medical personnel when an emergency situation arises are in the process of development, but ordinarily it is not the person who has had the accident, but the nurse who is in attendance who gives the report.

In the course of normal, everyday life, when people susceptible to the risks described above suddenly collapse or feel poorly, they will be able to call people nearby. In this way, they will be able to receive emergency treatment immediately.

This device was designed with the above situation in mind. Easy to use in a crisis situation, this emergency ring is a means of attracting people nearby.

SUMMARY OF THE INVENTION

This invention comprises a ring fitted with a transmission circuit and an alarm device that emits a sound. Encased in the setting of the ring, a switch at the top of the setting selectively provides a connection between the transmission circuit and the battery when pressed.

An alarm device that can be worn at all times and whose ease of operation allows nearby people to be called for assistance in times of emergencies.

BRIEF DESCRIPTION OF THE DRAWINGS

FIG. 1 is a plan view of a preferred embodiment of the instant invention.

FIG. 2 is a side view of a preferred embodiment of the instant invention.

FIG. 3 is a schematic diagram of the circuit utilized in the instant invention.

DESCRIPTION OF A PREFERRED EMBODIMENT

FIG. 1 shows the front or plan view of the ring with alarm device. Ring 1 is an annular device for encircling a finger or the like. The setting 2 is mounted on ring 1. The pushbutton switches 3*a* and 3*b* are disposed on opposite sides of the setting 2.

FIG. 2 is a side view of the ring shown in FIG. 1.

FIG. 3 shows the structure of the alarm device. The transmission circuit 4 selectively supplies the signal to generate a sound by a suitable transducer 5, for example, a buzzer or miniature speaker. The battery 6, for example, a mercury battery, is connected to the circuit 4. These components are all mounted in the setting 2.

The pushbutton switches 3*a* and 3*b* are serially connected and normally open. Thus, the circuit 4 is not energized and the transducer 5 is not activated.

However, by pushing both pushbutton switches 3*a* and 3*b* at the same time (in the direction of the arrows shown in FIG. 1), the connection between the battery 6 and the transmission circuit 4 is closed. This causes the circuit 4 to be energized and, thus, speaker 5 to be activated and emit a sound. The length of the sound emission depends upon the strength of the battery 6. For example, 30 seconds would be sufficient.

This device was designed with two serially connected push-button switches. It is possible to accidentally hit one switch and set off the alarm inadvertently. However, to activate two switches requires an intentional action. The possibility of accidentally pressing both switches 3*a* and 3*b* at the same time is slight, especially since the switches need to be pressed in opposite directions. This ring could naturally be fitted with only one switch if inadvertent actuation is not a problem. For example, a single switch could require a larger throw, larger pressure or longer press time.

The structure of this emergency ring is such that elderly, physically handicapped, or people suffering from heart disease or high blood pressure can push buttons 3*a* and 3*b* (for example, with the thumb and forefinger). This will sound the alarm alerting people nearby allowing quick action to be taken to save a valuable life.

This emergency ring could also be suitable for other purposes including scaring away molesters and other types of crime prevention.

A transmission circuit 4 of known design and a conventional sound device 5 and battery 6 are enclosed in the ring setting 2. In an emergency, pressing the pushbutton switches 3*a* and 3*b* at the top of the setting forms a connection between the transmission circuit 4 and the battery 6 and causes the alarm device to emit a sound.

The circuit 4 can be activated solely by pressure on the switches 3*a* and 3*b* or it can include a "one-shot" device 4A to maintain the circuit 4 in the activated state once its switches are operated.

Benefits of the Device

A device that is easy to use and will alert people during times of emergency must meet the following conditions:

1. Can be worn at all times (even when showering)
2. Comfortable
3. Easy to sound the alarm
4. Inexpensive As this device is a ring, there is no need to take it off even while bathing. (Typically, the ring will, of course, be waterproofed.) The ring will be worn on one hand and operated by the other hand, so there is no need to fuss around. As long as the person is conscious it will be possible to operate the device.

As mentioned above, this device when worn at all times, is comfortable, extremely easy to operate and able to attract the attention of people nearby in times of emergencies.

Thus, there is shown and described a unique design and concept of a ring fitted with a device that sounds an alarm. The particular configuration shown and described herein relates to a ring selectively operative for emitting a sound to call people in times of emergencies.

While this description is directed to a particular embodiment, it is understood that those skilled in the art may conceive modifications and/or variations to the specific embodiments shown and described herein. Any such modifications or variations would fall within the purview of this description are intended to be included therein as well. It is understood that the description herein is intended to be illustrative only and is not intended to be limitative. Rather, the scope of the invention described herein is limited only by the claims appended hereto.

I claim:

1. An emergency alarm device comprising, mounting means for mounting said device to a user, said mounting means comprises a finger ring, housing means attached to said mounting means, said housing means comprises a setting attached to said finger ring, circuit means disposed in said housing means, transducer means connected to said circuit means, said transducer means adapted to produce a sound when energized, battery means, and switch means disposed in said housing means, said switch means connected between said circuit means and said battery means whereby said battery means is selectively connected to said circuit means to thereby energize said transducer means, said switch means is normally open to disconnect said battery means from said circuit means, said switch means includes two switches connected in series and which must be closed at the same time in order to connect said battery means to said circuit means, said two switches are disposed on opposite sides of said housing means, said transducer means is energized only when said switch means is activated when said two switches are closed at the same time, said two switches are arranged so that they are operated by forces applied in different directions.

2. The device recited in claim 1 wherein, said circuit means includes a one-shot device.

* * * * *